US011524222B2

(12) United States Patent
Kunihiro et al.

(10) Patent No.: US 11,524,222 B2
(45) Date of Patent: Dec. 13, 2022

(54) POLYHEDRAL TOY

(71) Applicant: Hanayama International Trading Limited, Tsim Sha Tsui (CN)

(72) Inventors: Kobayashi Kunihiro, Tsim Sha Tsui (CN); Nishihara Akira, Tsim Sha Tsui (CN)

(73) Assignee: Hanayama International Trading Limited, Kowloon (CN)

( * ) Notice: Subject to any disclaimer, the term of this patent is extended or adjusted under 35 U.S.C. 154(b) by 0 days.

(21) Appl. No.: 17/295,826

(22) PCT Filed: Nov. 21, 2018

(86) PCT No.: PCT/JP2018/043030
§ 371 (c)(1),
(2) Date: May 20, 2021

(87) PCT Pub. No.: WO2020/105149
PCT Pub. Date: May 28, 2020

(65) Prior Publication Data

US 2022/0008816 A1 Jan. 13, 2022

(51) Int. Cl.
*A63F 9/08* (2006.01)

(52) U.S. Cl.
CPC ..... *A63F 9/0826* (2013.01)

(58) Field of Classification Search
CPC ..... A63F 9/0826; A63F 9/088; A63H 33/04
See application file for complete search history.

(56) References Cited

U.S. PATENT DOCUMENTS 2,992,829 A * 7/1961 Hopkins ..... A63F 9/088 428/542.2
3,746,345 A * 7/1973 Palazzolo ..... A63F 9/088 446/127

(Continued)

FOREIGN PATENT DOCUMENTS

EP 69188 1/1983
EP 0069188 A1 * 12/1983

(Continued)

OTHER PUBLICATIONS

International Preliminary Report on Patentability in International Appln. No. PCT/JP2018/043030, dated Jun. 3, 2021, 11 pages (with English translation).

(Continued)

*Primary Examiner* — Steven B Wong
(74) *Attorney, Agent, or Firm* — Fish & Richardson P.C.

(57) ABSTRACT

Provided is a polyhedral toy which has a wider variety of playing patterns and cannot be predicted in terms of change in forms to thereby enable enhancement of elements of puzzles. A first polyhedral piece for forming an upper face of a cube is coupled to a second polyhedral piece for forming a first side face of the cube and a third polyhedral piece for forming a second side face adjacent to the first side face at respective sides of bottom faces of the first polyhedral piece, the second polyhedral piece, and the third polyhedral piece. The second polyhedral piece is coupled to a fourth polyhedral piece for forming a third side face opposed to the second side face of the cube at respective sides of the bottom face of the second polyhedral piece and a bottom face of the fourth polyhedral piece. The fourth polyhedral piece is coupled to a fifth polyhedral piece for forming a lower face opposed to the upper face of the cube at respective sides of the bottom face of the fourth polyhedral piece and a bottom face of the fifth polyhedral piece. The fifth polyhedral piece (Continued)

is coupled to a sixth polyhedral piece for forming a fourth side face opposed to the first side face of the cube at respective sides of the bottom face of the fifth polyhedral piece and a bottom face of the sixth polyhedral piece. The third polyhedral piece of a first cube is coupled to the sixth polyhedral piece of a second cube at respective sides of the bottom faces of the third polyhedral piece of the first cube and the sixth polyhedral piece of the second cube, and the third polyhedral piece of the second cube is coupled to the sixth polyhedral piece of the first cube at respective sides of the bottom faces of the third polyhedral piece of the second cube and the sixth polyhedral piece of the first cube.

20 Claims, 22 Drawing Sheets

(56) References Cited

U.S. PATENT DOCUMENTS 4,063,725 A * 12/1977 Snyder ..... A63F 9/088 273/155
4,323,244 A * 4/1982 Busing ..... A63F 9/12 446/102
4,461,480 A 7/1984 Mitchell
4,650,424 A 3/1987 Mitchell
5,322,284 A * 6/1994 El-Agamawi ..... A63F 9/088 273/159
5,630,587 A * 5/1997 Zlotsky ..... A63F 9/088 446/111
6,050,566 A * 4/2000 Shameson ..... A63F 9/0613 273/156
6,158,740 A * 12/2000 Hall ..... A63F 9/12 273/156
6,264,199 B1 * 7/2001 Schaedel ..... A63F 9/088 273/157 R
6,386,541 B1 * 5/2002 Cornelius ..... A63F 9/088 273/157 R
8,087,671 B2 * 1/2012 Houlis ..... A63F 9/083 273/156
2010/0264584 A1 10/2010 Maddock
2012/0049448 A1 * 3/2012 Agamawi ..... A63F 9/1208 273/153 S
2012/0049449 A1 * 3/2012 Agamawi ..... A63F 9/0869 273/153 S
2012/0049450 A1 * 3/2012 Agamawi ..... A63F 9/0869 273/153 S
2021/0275904 A1 * 9/2021 Guenzani ..... A63F 9/1208

FOREIGN PATENT DOCUMENTS

EP 0787514 A2 * 8/1997
EP 3639902 A1 * 4/2020 ..... A63F 9/088
GB 2107200 4/1983
GB 2108395 * 5/1983
GB 2111395 A * 7/1983 ..... A63F 9/088
JP S63-36272 7/1988
JP H956925 3/1997
JP 3167890 5/2011
JP 201187883 5/2011
JP 5814181 11/2015
JP 5822185 11/2015
JP 5848297 1/2016
JP 6118935 4/2017
JP 6317504 4/2018
JP 6336272 6/2018
JP 6410955 10/2018
KR 20090006648 * 1/2009

OTHER PUBLICATIONS

PCT International Search Report and Written Opinion in International Appln. No. PCT/JP2018/043030, dated Feb. 14, 2019, 8 pages (with English translation).

* cited by examiner

[Fig.1]
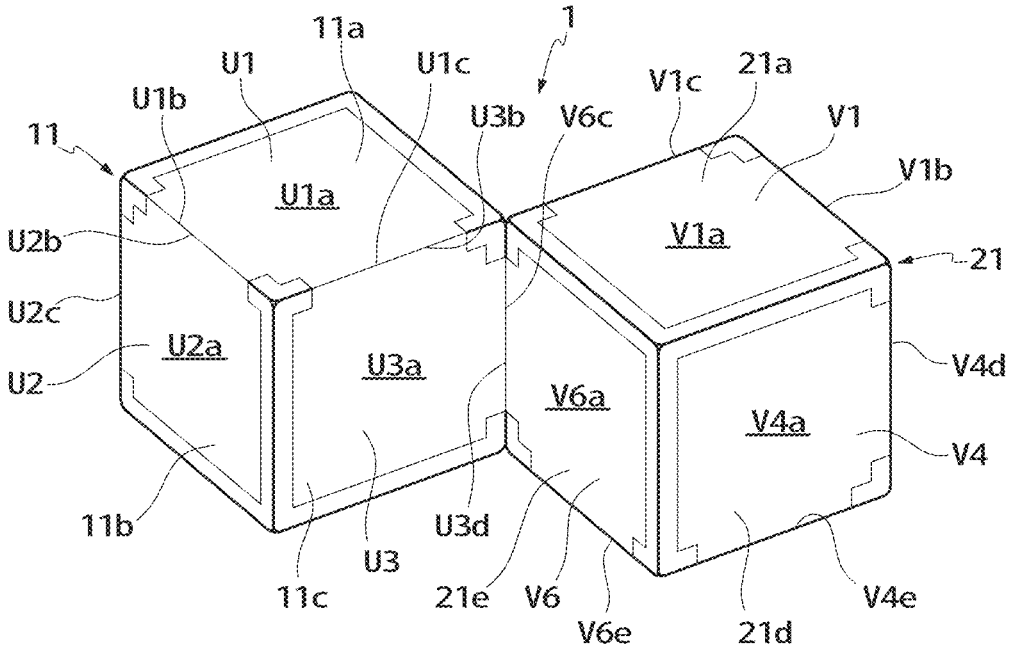
[Fig.2]
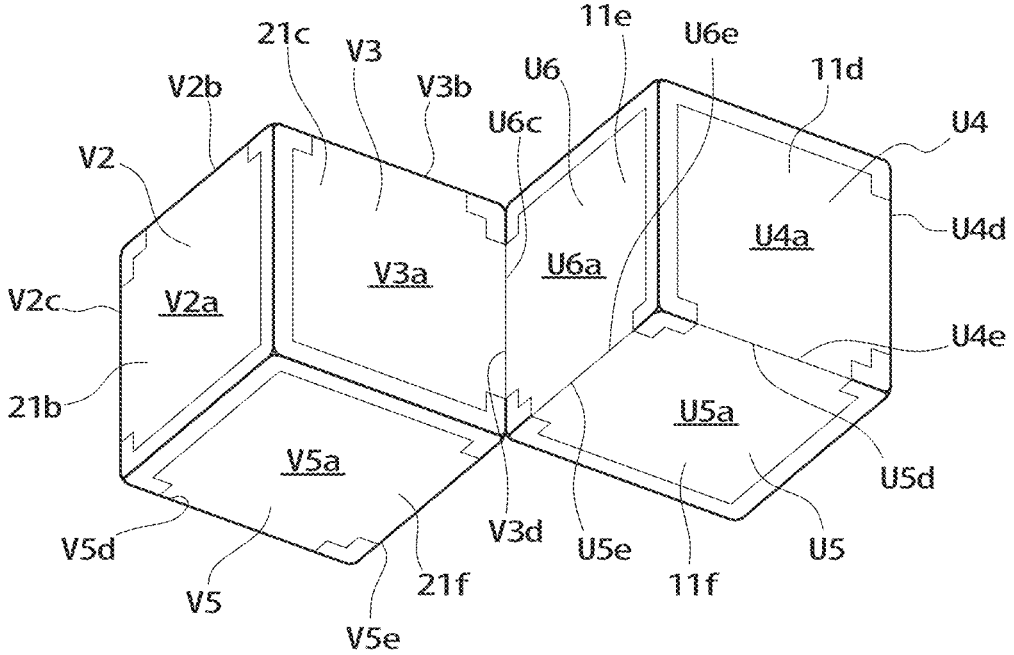

[Fig.3]
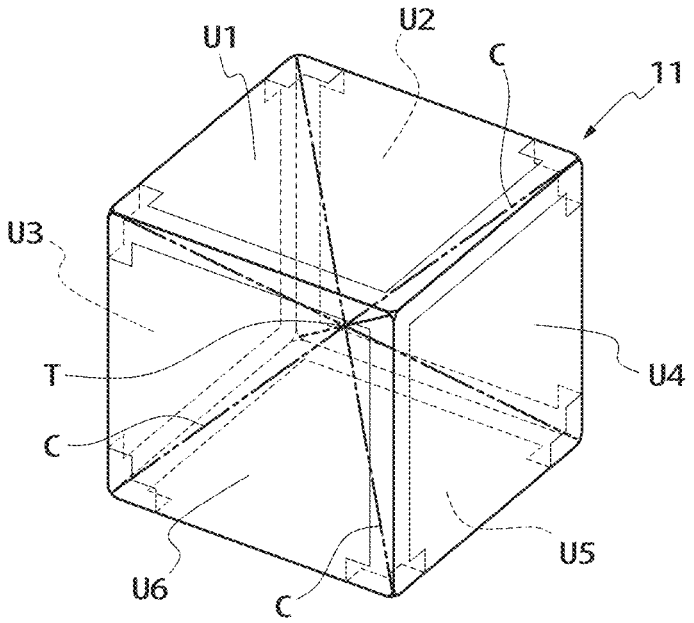
[Fig.4]
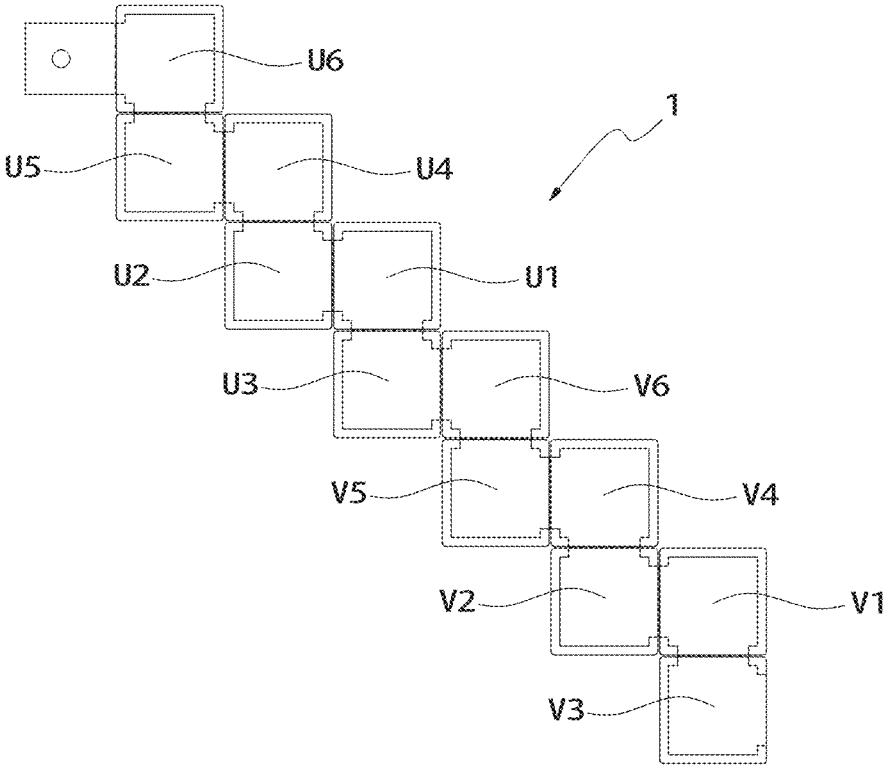

[Fig.5]
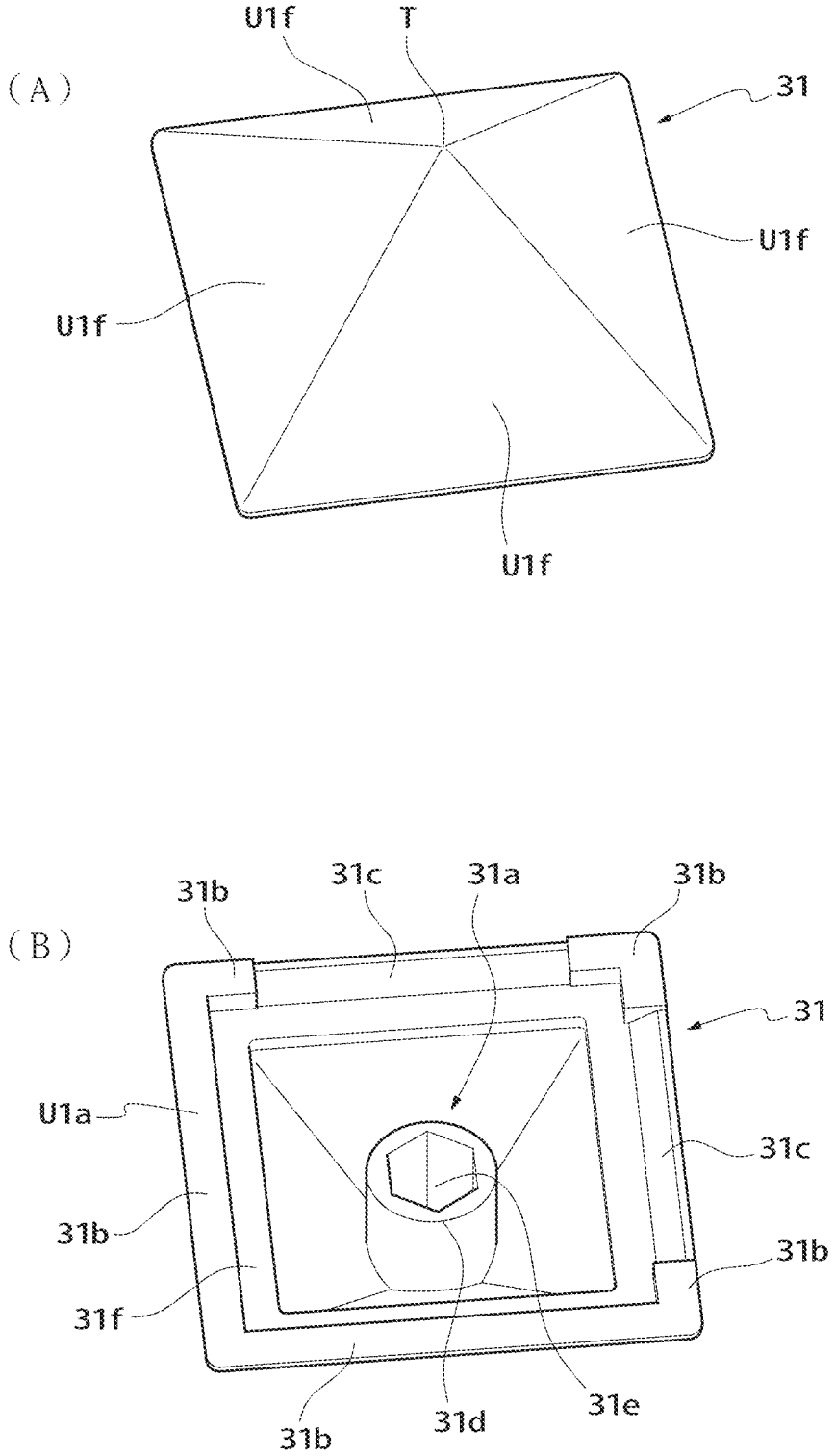

[Fig.6]
(A)
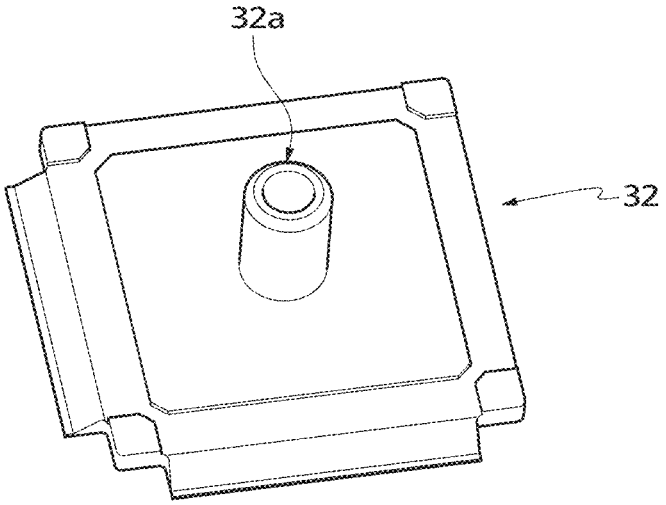
(B)
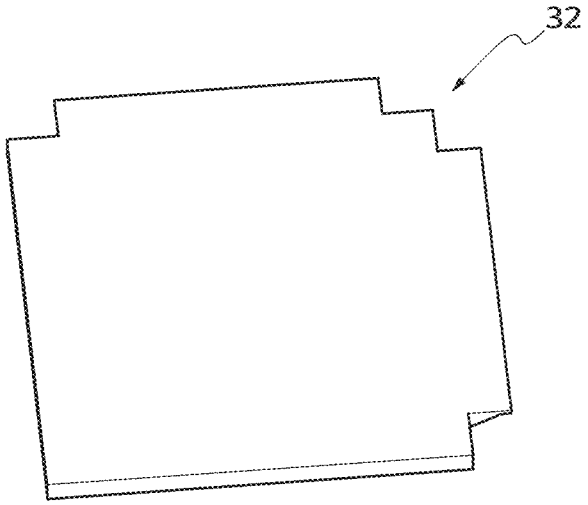

[Fig.7]
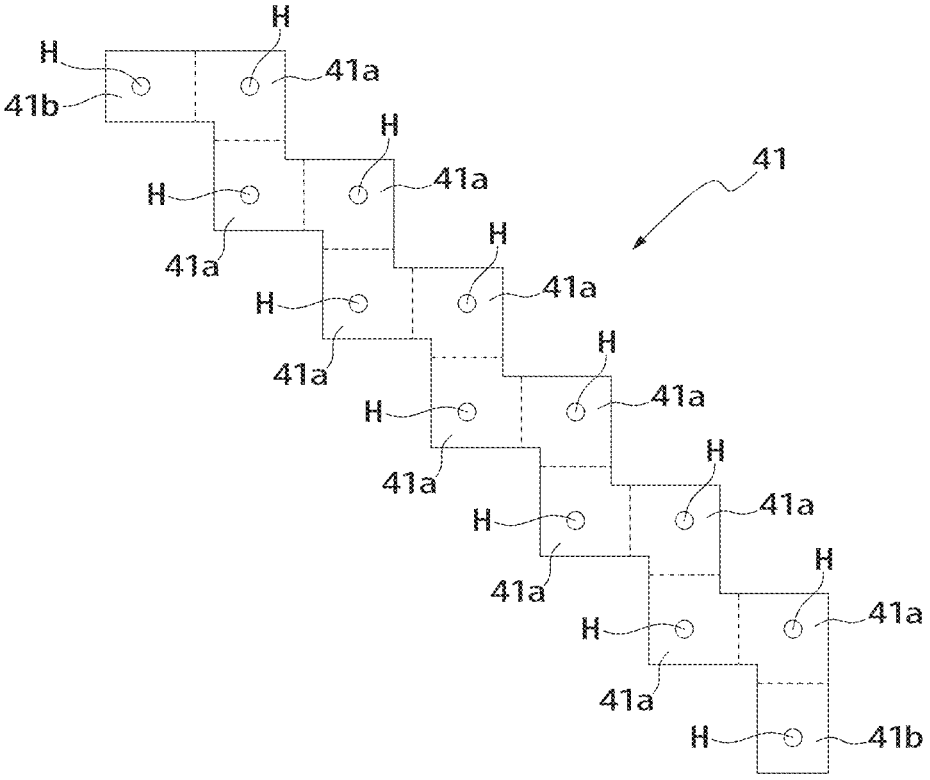
[Fig.8]
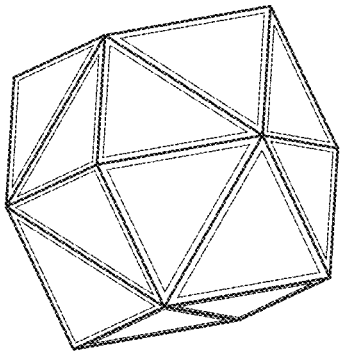

[Fig.9]
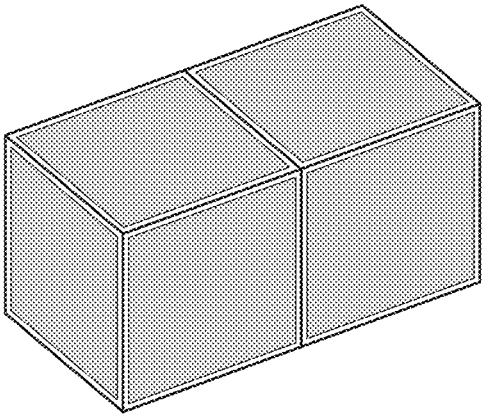
[Fig.10]
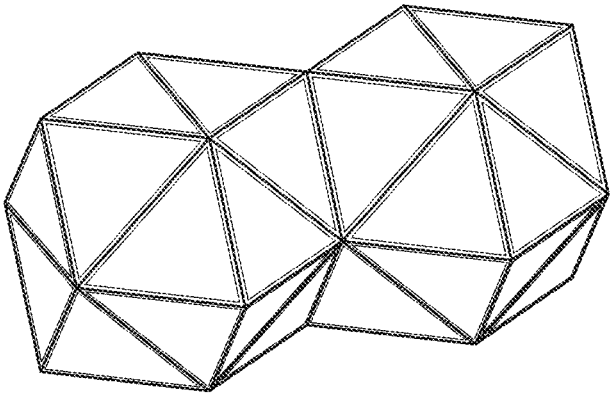

[Fig.11]
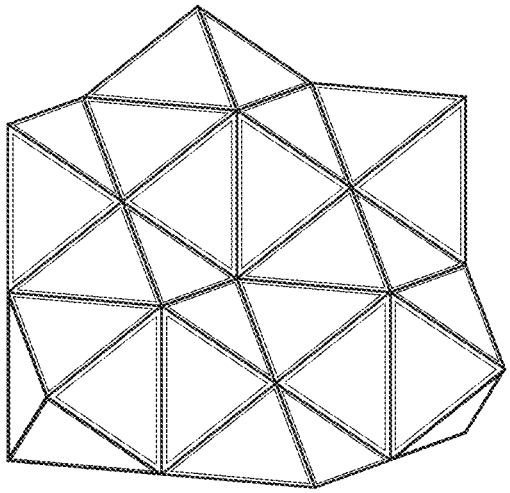
[Fig.12]
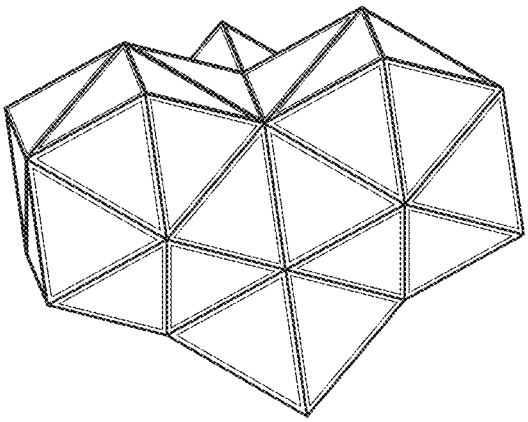

[Fig.13]
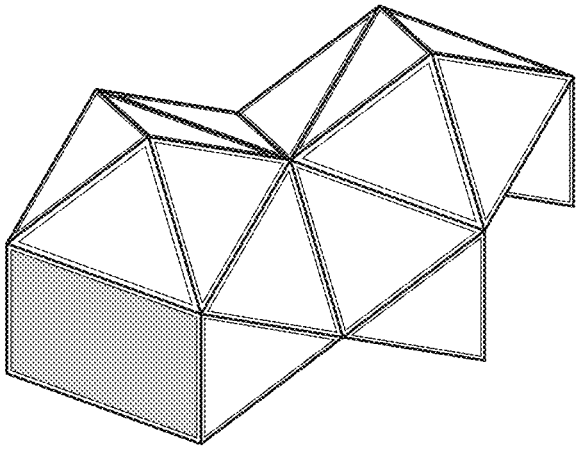
[Fig.14]
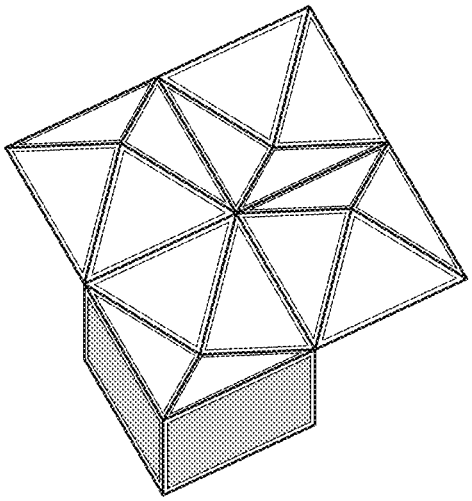

[Fig.15]
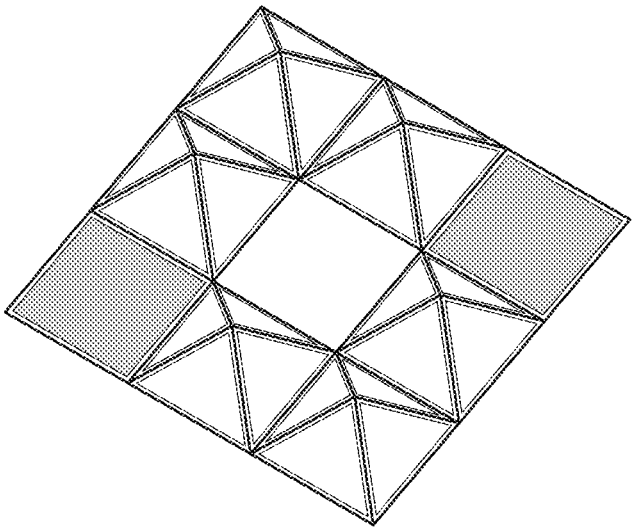
[Fig.16]
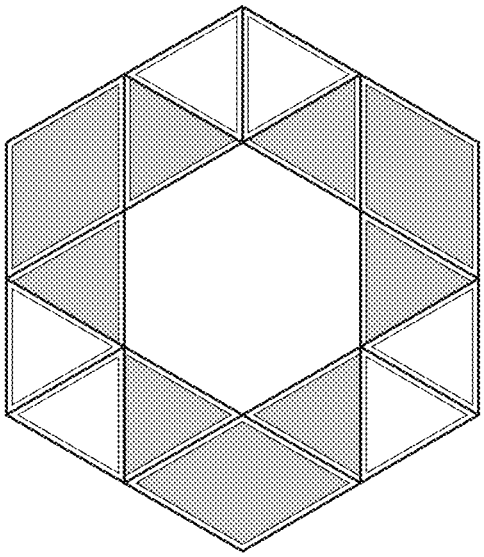

[Fig.17]
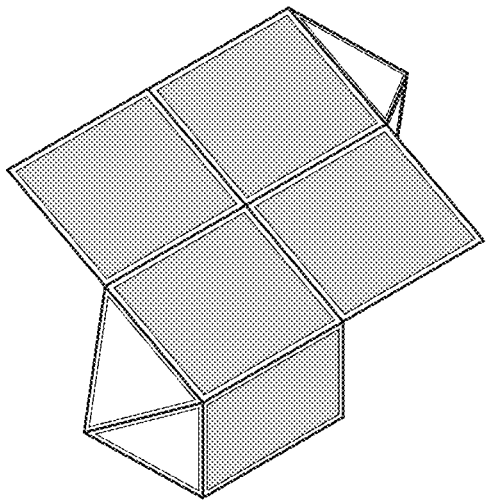
[Fig.18]
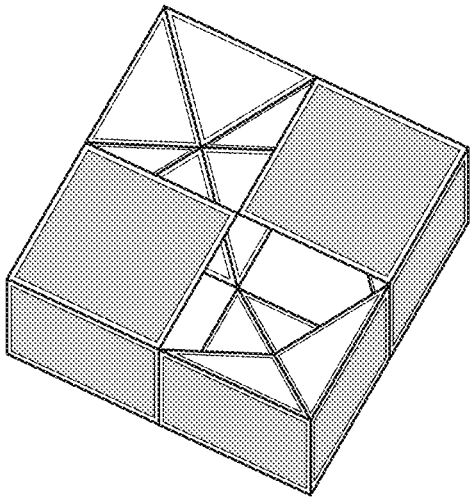

[Fig.19]
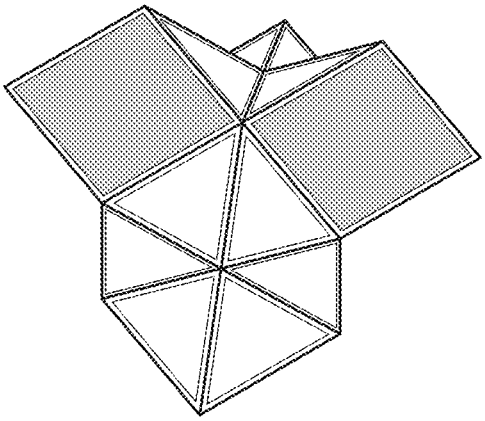
[Fig.20]
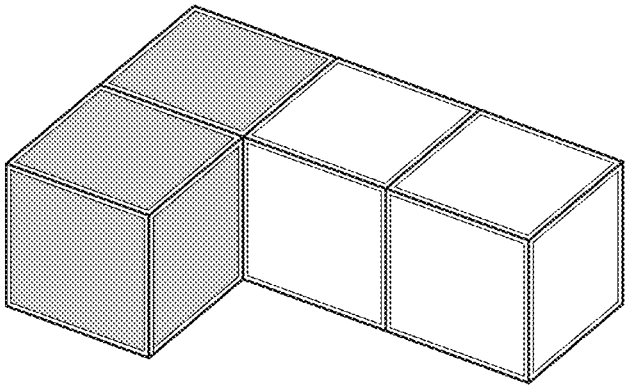

[Fig.21]
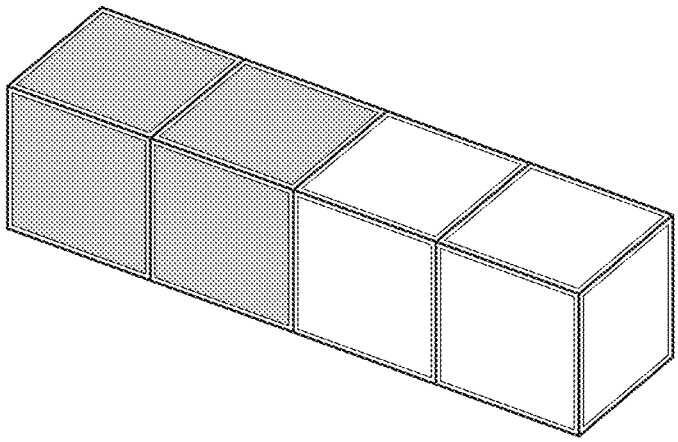
[Fig.22]
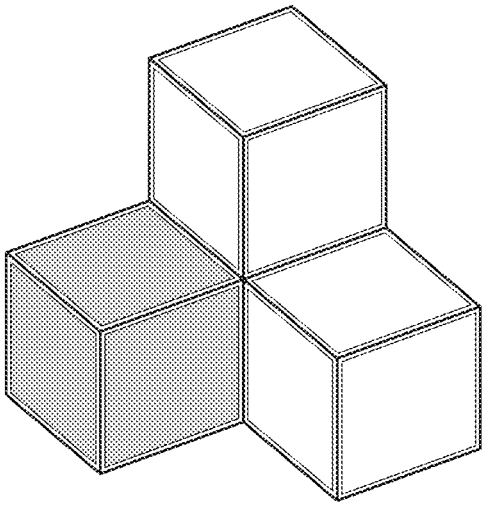

[Fig.23]
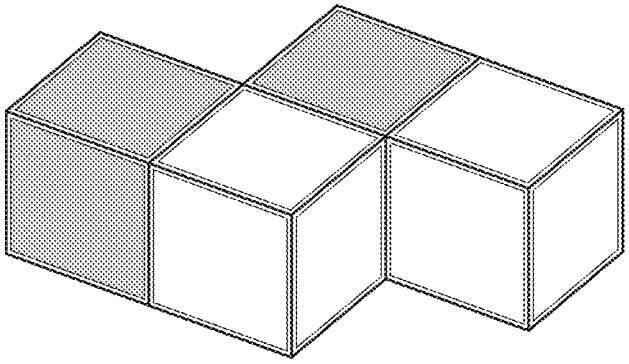
[Fig.24]
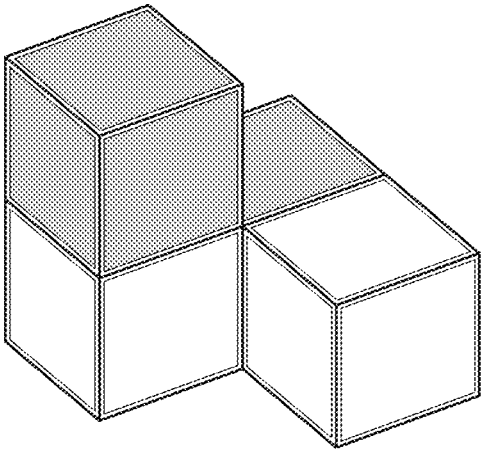

[Fig.25]
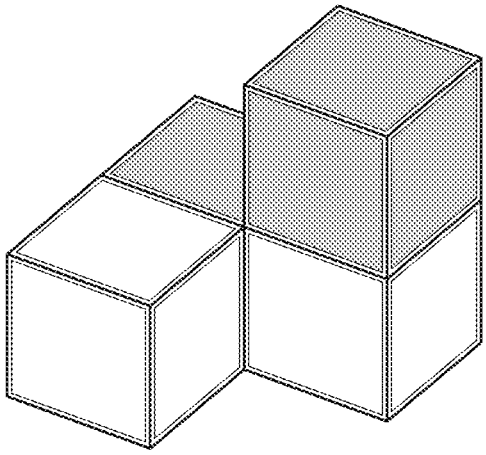
[Fig.26]
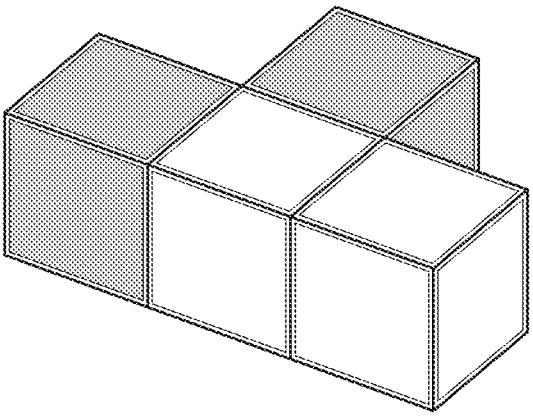

[Fig.27]
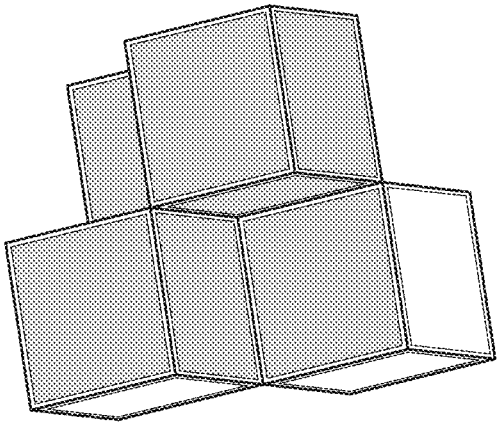
[Fig.28]
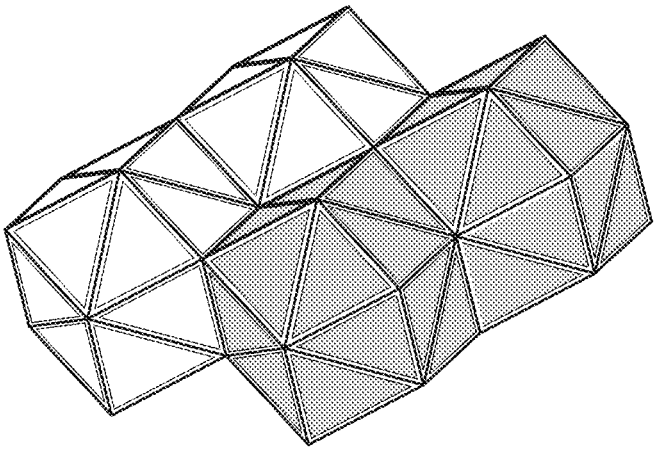

[Fig.29]
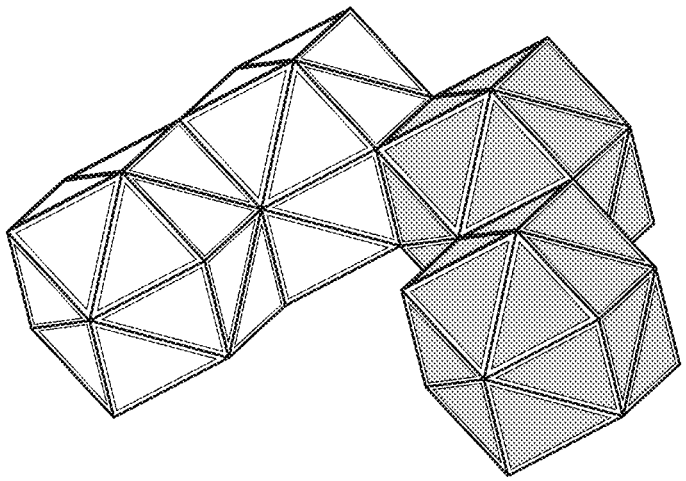
[Fig.30]
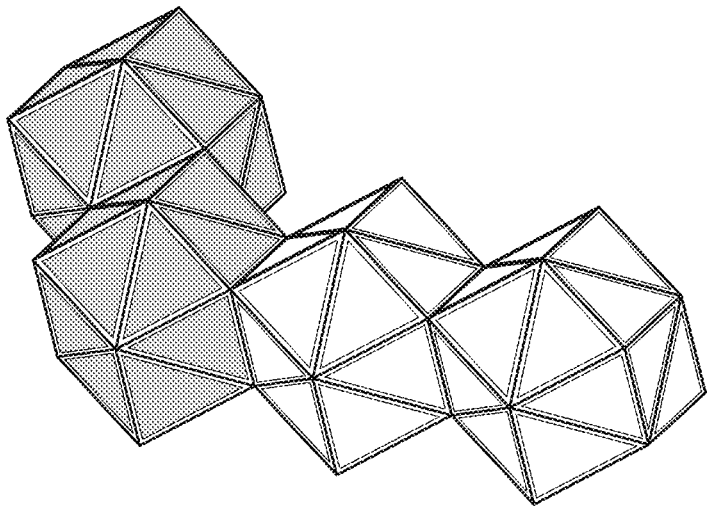

[Fig.31]
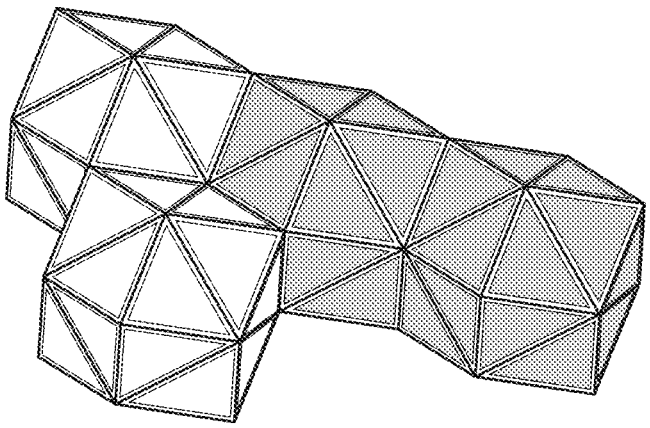
[Fig.32]
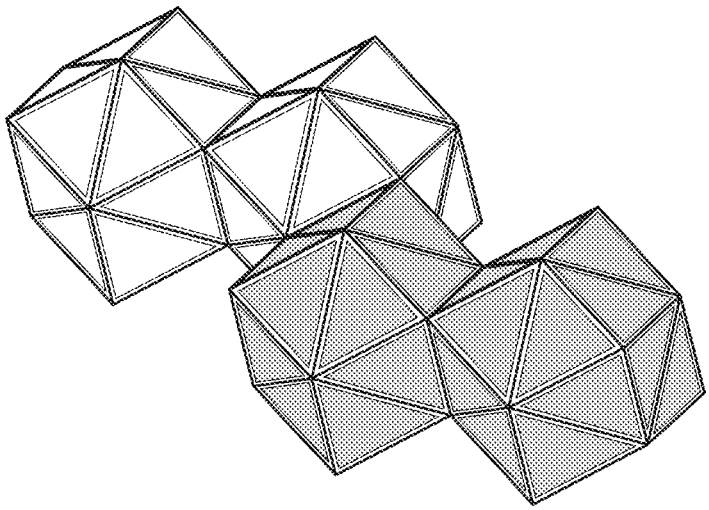

[Fig.33]
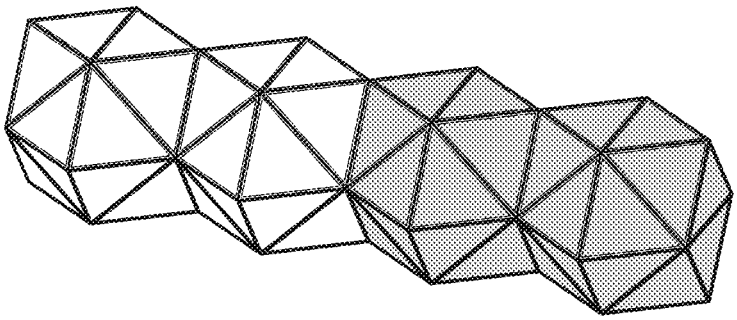
[Fig.34]
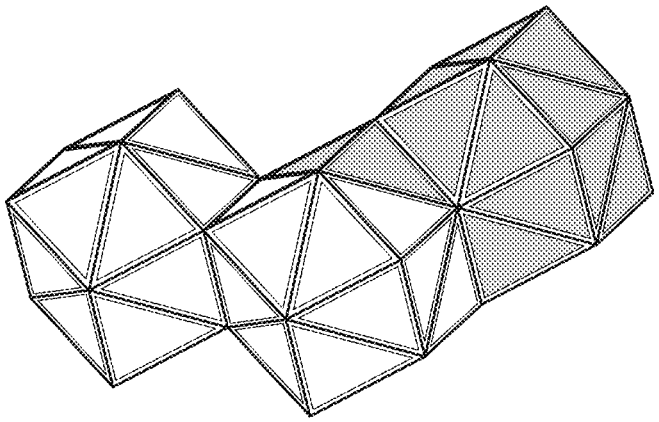

[Fig.35]
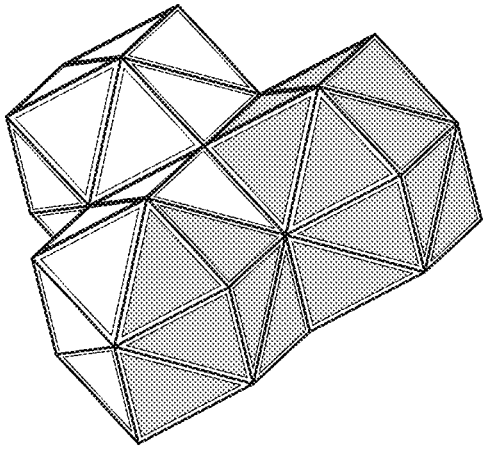
[Fig.36]
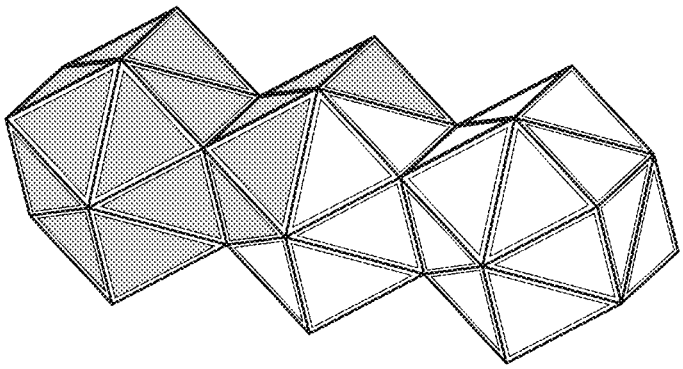

[Fig.37]
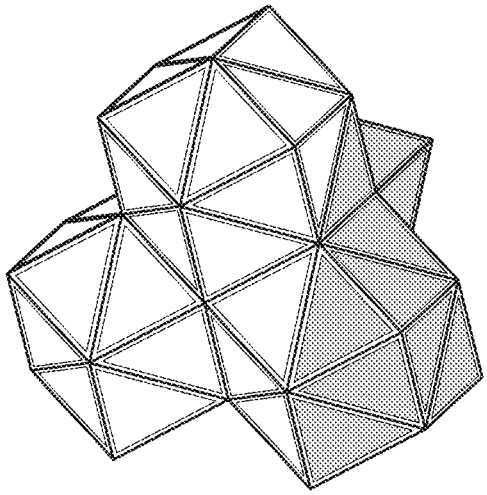
[Fig.38]
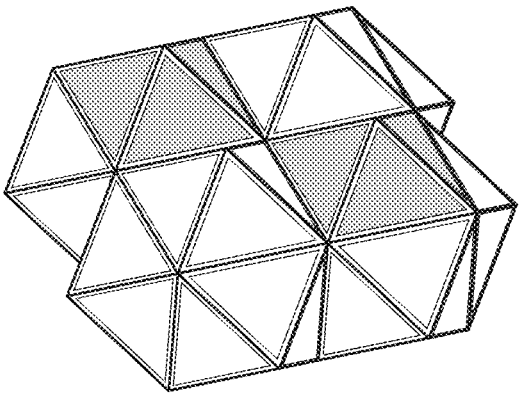

[Fig.39]
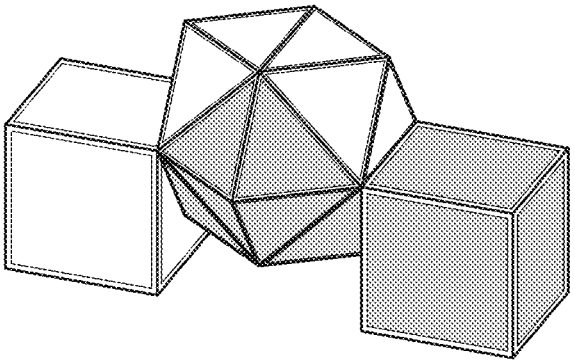
[Fig.40]
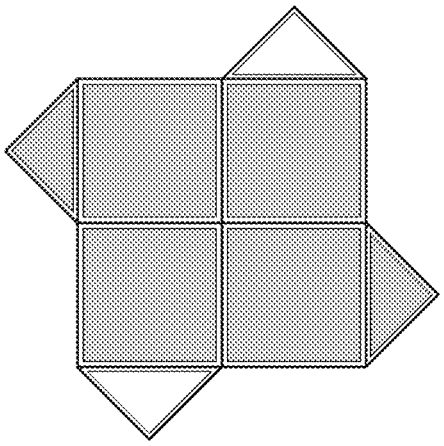

[Fig.41]
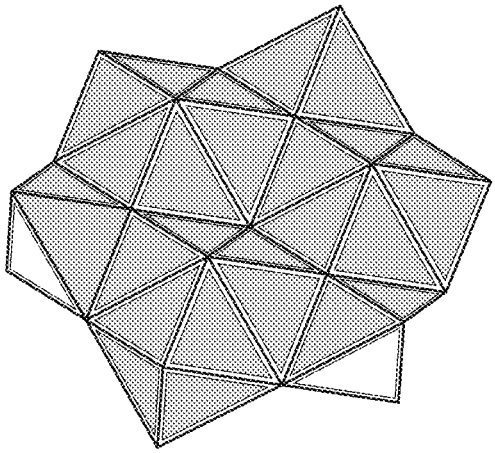
[Fig.42]
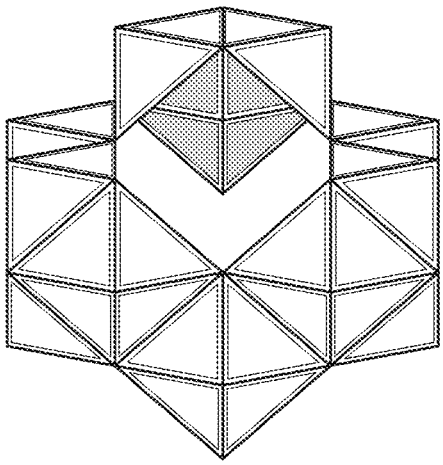

POLYHEDRAL TOY

TECHNICAL FIELD

The present invention relates to a polyhedral toy, which can be transformed from a form of a cuboid into various forms.

BACKGROUND ART

Hitherto, there has been known a polyhedral toy formed of two toy main bodies that can be fitted to each other by male/female fitting and can further be transformed between a stellated polyhedron and a cube. A configuration thereof and a manufacturing method therefor are disclosed in Patent Literature 1.

When the two toy main bodies are referred to as "toy main body A" and "toy main body B", the toy main body A and the toy main body B are each formed of eight polyhedral unit bodies.

Playing methods mainly include two patterns.

One of the patterns is as follows.

The form illustrated in FIG. 1 of Patent Literature 1 is an initial form of the toy main body A. When the toy main body A is unfolded from this state around a division line 14 (see FIG. 1 of Patent Literature 1), the toy main body B of a stellated polyhedron appears from the inside. The toy main body B of a stellated polyhedron is taken out and separated from the toy main body A. After the toy main body B is separated from the toy main body A, the toy main body A is unfolded to complete the stellated polyhedron.

Another one of the patterns is as follows.

In the state of the initial form of the toy main body A, colors of squares forming the toy main body A appear on surfaces of the cube. The toy main body A is unfolded from this state around a division line intersecting the division line 14 to transform the toy main body A into the cube of the toy main body B so that colors of the squares forming the toy main body B appear.

That is, the playing methods of the polyhedral toy disclosed in Patent Literature 1 include a method of reversing surfaces of the cube of the toy main body A or the toy main body B to transform the cube into a cube of another color, and a method of transforming the toy main body A or the toy main body B between a cube and a stellated polyhedron.

However, the playing methods such as the transformation of the toy main body A or the toy main body B into a cube of another color and the transformation of the toy main body A or the toy main body B between a cube and a stellated polyhedron are limited in playing patterns.

Moreover, the playing methods basically involve the use of the toy main body A and the toy main body B in pair, and playing methods involving individual use of the toy main body A and the toy main body B are also limited.

Further, the playing methods basically involve the use of the toy main body A and the toy main body B in pair, and extensibility for achieving a wide variety of contents of play, such as combination of two or more cube toys, was poor.

CITATION LIST

Patent Literature

[PTL 1] JP S63-36272 A

SUMMARY OF INVENTION

Technical Problem

As described above, the patterns of the playing methods of the related-art polyhedral toy are limited. Thus, the present invention has an object to provide a polyhedral toy which has a wider variety of playing patterns than a related-art one and cannot be predicted in terms of change in forms to thereby enable enhancement of elements of puzzles.

Moreover, the present invention has an object to provide a polyhedral toy which can be enjoyed in terms of change in forms thereof even when only one polyhedral toy is used, and to provide a polyhedral toy having extensibility for achieving a wide variety of contents of play through combination of two or more polyhedral toys.

Solution to Problem

According to the present invention, there is provided a polyhedral toy, including twelve polyhedral pieces, wherein the polyhedral pieces each have a quadrangular pyramid shape, wherein, in a case in which a first cube and a second cube, each being formed of six polyhedral pieces, are formed so that triangle surfaces of each of the polyhedral pieces are placed on triangle surfaces of other ones of the polyhedral pieces and the two cubes are placed on the same plane, in plan view, in each of the first cube and the second cube, a first polyhedral piece for forming an upper face of the cube is coupled to a second polyhedral piece for forming a first side face of the cube and a third polyhedral piece for forming a second side face adjacent to the first side face at respective sides of bottom faces of the first polyhedral piece, the second polyhedral piece, and the third polyhedral piece, the second polyhedral piece is coupled to a fourth polyhedral piece for forming a third side face opposed to the second side face of the cube at respective sides of the bottom face of the second polyhedral piece and a bottom face of the fourth polyhedral piece, the fourth polyhedral piece is coupled to a fifth polyhedral piece for forming a lower face opposed to the upper face of the cube at respective sides of the bottom face of the fourth polyhedral piece and a bottom face of the fifth polyhedral piece, and the fifth polyhedral piece is coupled to a sixth polyhedral piece for forming a fourth side face opposed to the first side face of the cube at respective sides of the bottom face of the fifth polyhedral piece and a bottom face of the sixth polyhedral piece, wherein the third polyhedral piece of the first cube is coupled to the sixth polyhedral piece of the second cube at respective sides of the bottom faces of the third polyhedral piece of the first cube and the sixth polyhedral piece of the second cube, and wherein the third polyhedral piece of the second cube is coupled to the sixth polyhedral piece of the first cube at respective sides of the bottom faces of the third polyhedral piece of the second cube and the sixth polyhedral piece of the first cube.

In the present invention, it is preferred that the polyhedral toy include at least one polyhedral toy to be played.

In the present invention, it is preferred that the polyhedral toy include two polyhedral toys to be played through fitting to each other by male/female fitting.

In the present invention, it is preferred that the twelve polyhedral pieces be coupled through one coupling member.

In this case, it is preferred that the twelve polyhedral pieces be coupled through one coupling member so as to spaced apart from one another.

Further, in this case, it is preferred that a width dimension of the coupling member be shorter than a dimension of each of the sides of the bottom face of each of the polyhedral pieces.

Advantageous Effects of Invention

According to the present invention, there can be provided the polyhedral toy which has a wide variety of playing patterns and cannot be predicted in terms of change in forms to thereby enable enhancement of elements of puzzles.

BRIEF DESCRIPTION OF DRAWINGS

FIG. 1 is a perspective view of a polyhedral toy in a state of forming two cubes, as viewed from an upper face side.

FIG. 2 is a perspective view of the polyhedral toy in the state of forming two cubes, as viewed from a bottom face side.

FIG. 3 is a perspective view for illustrating a positional relationship among apices and sides of polyhedral pieces in the cube.

FIG. 4 is an example of a development view obtained by unfolding bottom faces of the polyhedral pieces of the toy.

FIG. 5(A) is a perspective view of a main body portion, as viewed from an upper face side, and FIG. 5(B) is a perspective view of the main body portion, as viewed from a bottom face side.

FIG. 6(A) is a perspective view of a lid portion, as viewed from an upper face side, and FIG. 6(B) is a perspective view of the lid portion, as viewed from a bottom face side.

FIG. 7 is a plan view of a coupling member.

FIG. 8 is a perspective view for illustrating a form of the polyhedral toy in a playing pattern A.

FIG. 9 is a perspective view for illustrating a form of the polyhedral toy in the playing pattern A.

FIG. 10 is a perspective view for illustrating a form of the polyhedral toy in the playing pattern A.

FIG. 11 is a perspective view for illustrating a form of the polyhedral toy in the playing pattern A.

FIG. 12 is a perspective view for illustrating a form of the polyhedral toy in the playing pattern A.

FIG. 13 is a perspective view for illustrating a form of the polyhedral toy in the playing pattern A.

FIG. 14 is a perspective view for illustrating a form of the polyhedral toy in the playing pattern A.

FIG. 15 is a perspective view for illustrating a form of the polyhedral toy in the playing pattern A.

FIG. 16 is a perspective view for illustrating a form of the polyhedral toy in the playing pattern A.

FIG. 17 is a perspective view for illustrating a form of the polyhedral toy in the playing pattern A.

FIG. 18 is a perspective view for illustrating a form of the polyhedral toy in the playing pattern A.

FIG. 19 is a perspective view for illustrating a form of the polyhedral toy in the playing pattern A.

FIG. 20 is a perspective view for illustrating a form of two polyhedral toys in a playing pattern B.

FIG. 21 is a perspective view for illustrating a form of the two polyhedral toys in the playing pattern B.

FIG. 22 is a perspective view for illustrating a form of the two polyhedral toys in the playing pattern B.

FIG. 23 is a perspective view for illustrating a form of the two polyhedral toys in the playing pattern B.

FIG. 24 is a perspective view for illustrating a form of the two polyhedral toys in the playing pattern B.

FIG. 25 is a perspective view for illustrating a form of the two polyhedral toys in the playing pattern B.

FIG. 26 is a perspective view for illustrating a form of the two polyhedral toys in the playing pattern B.

FIG. 27 is a perspective view for illustrating a form of the two polyhedral toys in the playing pattern B.

FIG. 28 is a perspective view for illustrating a form of two polyhedral toys in a playing pattern C.

FIG. 29 is a perspective view for illustrating a form of the two polyhedral toys in the playing pattern C.

FIG. 30 is a perspective view for illustrating a form of the two polyhedral toys in the playing pattern C.

FIG. 31 is a perspective view for illustrating a form of the two polyhedral toys in the playing pattern C.

FIG. 32 is a perspective view for illustrating a form of the two polyhedral toys in the playing pattern C.

FIG. 33 is a perspective view for illustrating a form of the two polyhedral toys in the playing pattern C.

FIG. 34 is a perspective view for illustrating a form of two polyhedral toys in a playing pattern D.

FIG. 35 is a perspective view for illustrating a form of the two polyhedral toys in the playing pattern D.

FIG. 36 is a perspective view for illustrating a form of the two polyhedral toys in the playing pattern D.

FIG. 37 is a perspective view for illustrating a form of the two polyhedral toys in the playing pattern D.

FIG. 38 is a perspective view for illustrating a form of the two polyhedral toys in the playing pattern D.

FIG. 39 is a perspective view for illustrating a form of the two polyhedral toys in the playing pattern D.

FIG. 40 is a perspective view for illustrating a form of the two polyhedral toys in the playing pattern D.

FIG. 41 is a perspective view for illustrating a form of the two polyhedral toys in the playing pattern D.

FIG. 42 is a perspective view for illustrating a form of the two polyhedral toys in the playing pattern D.

DESCRIPTION OF EMBODIMENT

Now, an embodiment of the present invention is described in detail by examples with reference to the drawings. In Description, common terms are used for common components. In the drawings, the common components are illustrated as substantially the same, and detailed description thereof is omitted. The common components are denoted by the same reference symbols as needed.

A polyhedral toy (hereinafter also referred to simply as "toy") 1 according to this embodiment includes twelve polyhedral pieces U1 to U6 and V1 to V6. The polyhedral pieces U1 to U6 and V1 to V6 have quadrangular pyramid shapes with bottom faces U1*a* to U6*a* and V1*a* to V6*a*, four sides U1*b* to U6*b* and V1*b* to V6*b*, U1*c* to U6*c* and V1*c* to V6*c*, U1*d* to U6*d* and V1*d* to V6*d*, and U1*e* to U6*e* and V1*e* to V6*e* of the bottom faces U1*a* to U6*a* and V1*a* to V6*a*, and four triangle surfaces U1*f* to U6*f* and V1*f* to V6*f*, U1*g* to U6*g* and V1*g* to V6*g*, U1*h* to U6*h* and V1*h* to V6*h*, and U1*i* to U6*i* and V1*i* to V6*i*, respectively. In FIG. 1, six polyhedral pieces U1 to U6 form a first cube 11, and six polyhedral pieces V1 to V6 form a second cube 21. In FIG. 1 and FIG. 2, there is illustrated a state in which the first cube 11 and the second cube 21 are placed on the same plane. Among components of the second cube 21, components common to components of the first cube 11 are denoted by the same names and reference symbols as those of the components of the first cube 11, and description thereof is omitted.

Under the state illustrated in FIG. 1 and FIG. 2, triangle surfaces of each of the polyhedral pieces U1 to U6 are placed on triangle surfaces of other ones of the polyhedral pieces U1 to U6. Similarly, triangle surfaces of each of the polyhedral pieces V1 to V6 are placed on triangle surfaces of other ones of the polyhedral pieces V1 to V6. Thus, as illustrated in FIG. 3, the polyhedral pieces U1 to U6 and V1 to V6 are formed so as to have respective apices T of the quadrangular pyramid shapes at points at which diagonal lines C of the first cube 11 intersect each other and diagonal lines C of the second cube 21 intersect each other, and ridgelines are formed along the diagonal lines C. In FIG. 3, the diagonal lines C are indicated by alternate long and short dash lines.

In this embodiment, the first polyhedral pieces U1 and V1 form upper faces 11*a* and 21*a* of the first cube 11 and the second cube 21, respectively, under a state in which the first cube 11 and the second cube 21 are placed on the same plane.

The second polyhedral pieces U2 and V2 form first side faces 11*b* and 21*b* of the first cube 11 and the second cube 21, respectively.

The third polyhedral pieces U3 and V3 form second side faces 11*c* and 21*c* of the first cube 11 and the second cube 21, respectively. The second side faces 11*c* and 21*c* are adjacent to the first side faces 11*b* and 21*b*, respectively.

The fourth polyhedral pieces U4 and V4 form third side faces 11*d* and 21*d* of the first cube 11 and the second cube 21, respectively. The third side faces 11*d* and 21*d* are opposed to the second side faces 11*c* and 21*c*, respectively.

The fifth polyhedral pieces U5 and V5 form lower faces 11*f* and 21*f* of the first cube 11 and the second cube 21, respectively.

The sixth polyhedral pieces U6 and V6 form fourth side faces 11*e* and 21*e* of the first cube 11 and the second cube 21, respectively. The fourth side faces 11*e* and 21*e* are opposed to the first side faces 11*b* and 21*b*, respectively.

The above-mentioned polyhedral pieces U1 to U6 and V1 to V6 have the following coupling relationship in the first cube 11 and the second cube 21.

In the first cube 11, the upper face 11*a* of the first cube 11 is formed of the bottom face U1*a* of the quadrangular pyramid shape of the first polyhedral piece U1. The side U1*b* of the bottom face U1*a* is coupled to the side U2*b* of the bottom face U2*a* of the second polyhedral piece U2. Further, the side U1*c* of the bottom face U1*a* is coupled to the side U3*b* of the bottom face U3*a* of the third polyhedral piece U3.

The first side face 11*b* of the first cube 11 is formed of the bottom face U2*a* of the quadrangular pyramid shape of the second polyhedral piece U2. The side U2*c* of the bottom face U2*a* is coupled to the side U4*d* of the bottom face U4*a* of the fourth polyhedral piece U4.

The second side face 11*c* of the first cube 11 is formed of the bottom face U3*a* of the quadrangular pyramid shape of the third polyhedral piece U3.

The third side face 11*d* of the first cube 11 is formed of the bottom face U4*a* of the quadrangular pyramid shape of the fourth polyhedral piece U4. The side U4*e* of the bottom face U4*a* is coupled to the side U5*d* of the bottom face U5*a* of the fifth polyhedral piece U5.

The lower face 11*f* of the first cube 11 is formed of the bottom face U5*a* of the quadrangular pyramid shape of the fifth polyhedral piece U5. The side U5*e* of the bottom face U5*a* is coupled to the side U6*e* of the bottom face U6*a* of the sixth polyhedral piece U6.

The fourth side face 11*e* of the first cube 11 is formed of the bottom face U6*a* of the quadrangular pyramid shape of the sixth polyhedral piece U6.

In the second cube 21, the first polyhedral piece V1 to the sixth polyhedral piece V6 have the same coupling relationship as that of the first polyhedral piece U1 to the sixth polyhedral piece U6 in the first cube 11.

Further, the side U3*d* of the bottom face U3*a* of the quadrangular pyramid shape of the third polyhedral piece U3 for forming the first cube 11 is coupled to the side V6*c* of the bottom face V6*a* of the quadrangular pyramid shape of the sixth polyhedral piece V6 for forming the second cube 21. Similarly, the side U3*c* of the bottom face U6*a* of the quadrangular pyramid shape of the sixth polyhedral piece U6 for forming the first cube 11 is coupled to the side V3*d* of the bottom face V3*a* of the quadrangular pyramid shape of the third polyhedral piece V3 for forming the second cube 21.

As described above, in the toy 1 according to this embodiment, the first cube 11 and the second cube 21 are coupled by a coupling structure between the third polyhedral piece U3 and the sixth polyhedral piece V6 and a coupling structure between the sixth polyhedral piece U6 and the third polyhedral piece V3.

As is apparent from FIG. 4, which is an example of a development view of the toy 1 according to this embodiment, in the toy 1 according to this embodiment, two adjacent sides of the bottom face of each of the polyhedral pieces U1 to U6 and V1 to V6 are coupled to other ones of the polyhedral pieces.

Now, configurations of the polyhedral pieces U1 to U6 and V1 to V6 are described taking the first polyhedral piece U1 as an example. Among components of the polyhedral pieces U2 to U6 and V1 to V6, components common to components of the polyhedral piece U1 are denoted by the same names and reference symbols as those of the components of the polyhedral piece U1, and description thereof is omitted.

As illustrated in FIG. 5 and FIG. 6, the first polyhedral piece U1 includes a main body portion 31 and a lid portion 32. The main body portion 31 has the four triangle surfaces U1*f* to U1*i* that form side faces of the quadrangular pyramid shape. The lid portion 32 is mounted to the main body portion 31 so as to close an opening portion 31*a* surrounded by end portions of the four triangle surfaces on the bottom face side. In this embodiment, both of the main body portion 31 and the lid portion 32 are made of a synthetic resin.

The four triangle surfaces U1*f* to U1*i* of the main body portion 31 according to this embodiment have bent portions 31*b*. The bent portions 31*b* are each formed by bending the end portion on the bottom face U1*a* side of the quadrangular pyramid shape toward the end portion of the triangle surface opposed thereto on the bottom face U1*a* side. It is preferred that a dimension of each of the bent portions 31*b* bent toward the end portion of the triangle surface opposed thereto on the bottom face U1*a* side be equal to or larger than 1.5 mm. With the dimension described above, strength and accuracy of the toy 1 can be ensured. In this embodiment, two triangle surfaces U1*f* and U1*g* adjacent to each other each have the bent portion 31*b* formed over the entire end portion on the bottom face U1*a* side of the quadrangular pyramid shape. Further, the two other triangle surfaces U1*h* and U1*i* adjacent to each other each have the bent portions 31*b* formed only in regions of both end portions in an extension direction of the end portion on the bottom face U1*a* side of the quadrangular pyramid shape, and the bent portion 31*b* is not formed in a central region in the extension direction of the end portion of the triangle surface. Specifically, in this embodiment, the two triangle surfaces U1*h* and U1*i* adjacent to each other each have a recessed portion 31*c*, which is formed in the central region in the extension direction of the end portion on the bottom face U1*a* side so as to be located between the bent portions 31*b*. When the recessed portion 31*c* described above is formed, it is preferred that a dimension of the bent portion 31*b* from a connection portion with an adjacent side in the extension direction of the end portion on the bottom face U1*a* side be equal to or larger than the dimension of the bent portion in a direction toward the end portion of the triangle surface opposed thereto on the bottom face U1*a* side, more specifically, fall within a range of from 100% to 200% of the bent portion extending in the direction toward the end portion of the triangle surface opposed thereto on the bottom face U1*a* side. With the dimension described above, instability and strength poverty of a sheet can be suppressed while the strength and the accuracy of the toy 1 are ensured.

The lid portion 32 has such a shape as to close the entire opening portion 31*a* of the main body portion 31. In particular, the lid portion 32 according to this embodiment has such a shape as to be slightly apart from the recessed portions 31*c* and close the entire recessed portions 31*c* on the bottom face U1*a* side. Further, the lid portion 32 according to this embodiment is formed so that the bent portions 31*b* and the lid portion 32 become substantially flush with each other under a state in which the lid portion 32 is mounted to the main body portion 31. As described above, in this embodiment, the bent portions 31*b* and the lid portion 32 form the bottom face U1*a* of the first polyhedral piece U1.

In this embodiment, in the main body portion 31, a cylindrical portion 31*d* is formed so as to extend from the apex T of the quadrangular pyramid shape toward the opening portion 31*a*. A columnar portion 32*a* to be fitted into a hollow portion 31*e* of the cylindrical portion 31*d* is formed on the lid portion 32. Thus, in this embodiment, when the columnar portion 32*a* is fitted into the cylindrical portion 31*d*, the opening portion 31*a* is closed to thereby form the polyhedral piece U1 having the quadrangular pyramid shape. In this embodiment, in particular, the hollow portion 31*e* is formed to have a hexagonal sectional shape, and the columnar portion 32*a* is formed to have a circular sectional shape. When the hollow portion 31*e* and the columnar portion 32*a* are formed to have different sectional shapes as described above, the columnar portion 32*a* can easily be inserted into the hollow portion 31*e*.

In this embodiment, in particular, in the main body portion 31, a pressing stopper portion 31*f* is formed in the vicinity of the end portion of the quadrangular pyramid shape on the bottom face U1*a* side. In this embodiment, the pressing stopper portion 31*f* is formed in an annular shape along the entire end portion in the vicinity of the end portion of the quadrangular pyramid shape on the bottom face U1*a* side. With the formation of the pressing stopper portion 31*f* described above, when the columnar portion 32*a* is inserted into the hollow portion 31*e*, the lid portion 32 is prevented from being excessively urged by the main body portion 31 so that breakage of the main body portion is prevented.

The first polyhedral piece U1 according to this embodiment can be manufactured by, for example, preparing male and female dies for the main body portion 31 and the lid portion 32, respectively, and performing injection molding of a thermoplastic resin onto the dies using, for example, an injection molding machine.

In this embodiment, each of the polyhedral pieces U2 to U6 and V1 to V6 has substantially the same configuration as the configuration of the polyhedral piece U1. It is apparent that the triangle surface on which the recessed portion 31*c* is formed can be suitably changed as needed.

Next, a specific coupling structure for the polyhedral pieces U1 to U6 and V1 to V6 is described. The toy 1 according to this embodiment includes a coupling member 41. Each of the polyhedral pieces U1 to U6 and V1 to V6 is coupled to another one of the polyhedral pieces through the coupling member 41. In other words, in the toy 1 according to this embodiment, the polyhedral pieces are indirectly coupled to one another.

As illustrated in FIG. 7, the coupling member 41 according to this embodiment is formed of one sheet having a step-like shape. More specifically, the coupling member 41 according to this embodiment has such a structure that eleven L-shaped portions 41*a* and two rectangular portions 41*b* are connected. In this embodiment, the eleven L-shaped portions 41*a* and the two rectangular portions 41*b* are integrally formed.

In this embodiment, the eleven L-shaped portions 41*a* have the same shape, and are connected to each other to form a step-like shape. The L-shaped portions 41*a* according to this embodiment each have such a shape that is formed by cutting off a small square from one corner of a large square. Thus, each of the L-shaped portions 41*a* is axisymmetric about a diagonal line of the large square before the small square is cut off as an axis.

Each of long sides of the rectangular portion 41*b* has the same dimension as a dimension of a side of the large square of the L-shaped portion 41*a* before the small square is cut off. Further, each of short sides of the rectangular portion 41*b* has a dimension equal to a difference between the dimension of the side of the large square and a dimension of a side of the small square in the L-shaped portion 41*a*. In this embodiment, in particular, the dimension of each of the short sides of the rectangular portion 41*b* is set substantially equal to a dimension of the recessed portion 31*c* in a longitudinal direction thereof. Specifically, in this embodiment, a width dimension of the coupling member 41 is set to 60% of a dimension of the side of the bottom face of the polyhedral piece.

In FIG. 7, each boundary between the L-shaped portions and each boundary between the L-shaped portion and the rectangular portion are indicated by broken lines. The boundary indicated by the broken line is located midway between two polyhedral pieces to be coupled. In this embodiment, a through hole H is formed in each of the eleven L-shaped portions 41*a* and the two rectangular portions 41*b*.

The coupling member 41 according to this embodiment is made of polystyrene. The coupling member 41 having the sheet shape described above can be manufactured by, for example, punching a polystyrene sheet into a shape of the coupling member.

Next, an example of a mode of assembly of the toy 1 according to this embodiment is described. First, the two rectangular portions 41*b* of the coupling member 41 are placed on one another so as to align the through holes H with each other to thereby form the coupling member 41 into an annular shape. Next, the cylindrical portion 31*d* of the main body portion 31 is inserted into the through holes H of the two rectangular portions 41*b* that are placed on one another. After the insertion, the two rectangular portions 41*b* are placed on the two recessed portions 31*c*, respectively. After the placement, the columnar portion 32*a* of the lid portion 32 is fitted into the hollow portion 31*e* of the cylindrical portion

31*d* so that the coupling member 41 is held between the lid portion 32 and the recessed portions 31*c* to thereby form a first polyhedral piece.

Next, the cylindrical portion 31*d* of the main body portion 31 of another one of the polyhedral pieces is inserted into another one of the through holes H of the coupling member 41 so that the vicinity of the boundary between the L-shaped portions 41*a* is placed on the recessed portion 31*c*. Then, the columnar portion 32*a* of the lid portion 32 is fitted into the hollow portion 31*e* of the cylindrical portion 31*d* to thereby form a second polyhedral piece.

After the same work is performed for the remaining through holes H of the coupling member 41, the toy 1 according to this embodiment, in which the twelve polyhedral pieces are coupled through the coupling member 41, is assembled.

In this embodiment, each of the polyhedral pieces U1 to U6 and V1 to V6 is indirectly coupled to another one of the polyhedral pieces through the coupling member 41. Thus, two polyhedral pieces, which are coupled to each other, are coupled so as to be spaced apart from each other. Thus, when one of the polyhedral pieces is rotated with respect to another one of the polyhedral pieces, obstruction to a rotating operation and breakage of the polyhedral piece during the rotating operation due to, for example, contact of the another one of the polyhedral pieces to the one polyhedral piece can be suppressed.

In this embodiment, in particular, the width dimension of the coupling member 41 at a portion at which the polyhedral pieces are coupled to each other is substantially the same as the dimension of each of the recessed portions 31*c* in the longitudinal direction. Thus, the polyhedral piece is coupled to another one of the polyhedral pieces only at the central regions in the extension direction of the end portions of the triangle surfaces, and is not coupled to the other polyhedral pieces at the regions of both end portions in the extension direction of the end portions of the triangle surfaces. Thus, two polyhedral pieces that are coupled to each other can be displaced so that the bottom faces thereof are twisted with respect to each other. Thus, the rotating operation can be smoothly performed, and a movable range of the polyhedral pieces that are coupled can be enlarged. Thus, a wide variety of forms of transformation can be provided.

Examples of Playing Methods of the Toy 1 Include the Following Patterns.

<Playing Pattern A>

In the playing pattern A, one toy 1 is prepared, and the toy 1 is transformed into various forms.

The toy 1 according to this embodiment can be transformed from the form of two cubes coupled to each other, which is illustrated in FIG. 1, to, for example, a form of one convex polyhedron (FIG. 8), a form of one cuboid (FIG. 9), a form of coupled two regular icosahedrons (FIG. 10), forms in which only the triangle surfaces of the polyhedral pieces are visible in plan view (FIG. 11 to FIG. 14), and forms in which the triangle surfaces and the bottom faces of the polyhedral pieces are visible in plan view (FIG. 15 to FIG. 19). In the forms illustrated in FIG. 9 to FIG. 19, two shapes which are symmetric about a center of the toy 1 or a plane passing through the center of the toy 1 as an axis are combined in plan view.

<Playing Pattern B>

In the playing pattern B, two toys 1 are prepared for play. With the two toys being referred to as "toy "a"" and "toy "b"", respectively, the toy "a" and the toy "b" are each transformed to the form of coupled two cubes, which is illustrated in FIG. 1, and/or to the form of forming one cuboid, which is illustrated in FIG. 9, and thereafter are combined with each other in a horizontal direction and a vertical direction to be transformed into a combination form with the arrangement of one or two stages (FIG. 20 to FIG. 27). In FIG. 20 to FIG. 27, the bottom faces and the triangle surfaces in the toy "a" are illustrated without any pattern thereon, and the bottom faces and the triangle surfaces in the toy "b" are illustrated with hatching.

<Playing Pattern C>

In the playing pattern C, two toys 1 are prepared for play. With the two toys being referred to as "toy "a"" and "toy "b"", respectively, the toy "a" and the toy "b" are each transformed to the form of one convex polyhedron, which is illustrated in FIG. 8, and thereafter are combined with each other in the horizontal direction and the vertical direction to be transformed into a combination form with the arrangement of one or two stages (FIG. 28 to FIG. 33). In FIG. 28 to FIG. 33, the bottom faces and the triangle surfaces in the toy "a" are illustrated without any pattern thereon, and the bottom faces and the triangle surfaces in the toy "b" are illustrated with hatching.

<Playing Pattern D>

In the playing pattern D, two toys 1 are prepared for play. With the two toys being referred to as "toy "a"" and "toy "b"", respectively, the toy "a" and the toy "b" are each transformed to, for example, the form in which the triangle surfaces and the bottom faces of the polyhedral pieces are visible in plan view, as illustrated in FIG. 15 to FIG. 29, and thereafter are transformed into a form of being fitted to each other by male/female fitting (FIG. 34 to FIG. 42). In FIG. 34 to FIG. 42, the bottom faces and the triangle surfaces in the toy "a" are illustrated without any pattern thereon, and the bottom faces and the triangle surfaces in the toy "b" are illustrated with hatching.

In this case, the form of being fitted by male/female fitting means a state in which a projecting portion formed with a plurality of faces of one of the toys is fitted into a recessed portion formed with a plurality of faces of another one of the toys.

As described above in the playing pattern A, even when only one toy 1 is used, the toy 1 can be enjoyed in terms of change in forms.

Further, as in the playing patterns B to D, a wide variety of playing patterns can be provided, and on this occasion, playing patterns which cannot be predicted in terms of change in forms can be provided. In the playing patterns B to D, in particular, when two toys 1 have different colors, elements of puzzles with focus on whether combinations of surface colors of cubes can be produced can be incorporated.

The present invention is not limited to the embodiment described above, and various modifications can be made by a person having ordinary skill in the art within the technical concept of the present invention.

In Description, even in a case in which the number of components of the invention is described as being any one of singular and plural or described without being limited to any of singular and plural, the number of components may be any of singular and plural except where the context otherwise requires.

The present invention has been described with reference to the drawings and with the detailed description of the embodiment. A person having ordinary skill in the art should understand that various changes or corrections are possible based on the disclosure contained in Description. Thus, the scope of the embodiment of the present invention is intended to include any change or correction.

REFERENCE SIGNS LIST

1: polyhedral toy
11 first cube
11*a*: upper face, 11*b*: first side face, 11*c*: second side face, 11*d*: third side face
11*e*: fourth side face, 11*f*: lower face
21: second cube
21*a*: upper face, 21*b*: first side face, 21*c*: second side face, 21*d*: third side face
21*e*: fourth side face, 21*f*: lower face
31: main body portion
31*a*: opening portion, 31*b*: bent portion, 31*c*: recessed portion, 31*d*: cylindrical portion
31*e*: hollow portion, 31*f*: pressing stopper portion
32: lid portion
32*a*: columnar portion
41: coupling member
41*a*: L-shaped portion, 41*b*: rectangular portion
C: diagonal line
H: through hole
T: apex
U1: first polyhedral piece
U1*a*: bottom face, U1*b*: side, U1*c*: side, U1*d*: side, U1*e*: side
U1*f*: triangle surface, U1*g*: triangle surface, U1*h*: triangle surface, U1*i*: triangle surface
U2 second polyhedral piece
U2*a*: bottom face, U2*b*: side, U2*c*: side, U2*d*: side, U2*e*: side
U3 third polyhedral piece
U3*a*: bottom face, U3*b*: side, U3*c*: side, U3*d*: side, U3*e*: side
U4 fourth polyhedral piece
U4*a*: bottom face, U4*b*: side, U4*c*: side, U4*d*: side, U4*e*: side
U5 fifth polyhedral piece
U5*a*: bottom face, U5*b*: side, U5*c*: side, U5*d*: side, U5*e*: side
U6 sixth polyhedral piece
U6*a*: bottom face, U6*b*: side, U6*c*: side, U6*d*: side, U6*e*: side
V1 first polyhedral piece
V1*a*: bottom face, V1*b*: side, V1*c*: side, V1*d*: side, V1*e*: side
V2 second polyhedral piece
V2*f*: triangle surface, V2*g*: triangle surface, V2*h*: triangle surface, V2*i*: triangle surface
V3 third polyhedral piece
V3*a*: bottom face, V3*b*: side, V3*c*: side, V3*d*: side, V3*e*: side
V4 fourth polyhedral piece
V4*a*: bottom face, V4*b*: side, V4*c*: side, V4*d*: side, V4*e*: side
V5 fifth polyhedral piece
V5*a*: bottom face, V5*b*: side, V5*c*: side, V5*d*: side, V5*e*: side
V6 sixth polyhedral piece
V6*a*: bottom face, V6*b*: side, V6*c*: side, V6*d*: side, V6*e*: side

The invention claimed is:

1. A polyhedral toy, comprising twelve polyhedral pieces, wherein the polyhedral pieces each have a quadrangular pyramid shape, wherein, under a state in which a first cube and a second cube, each being formed of six polyhedral pieces, are formed so that triangle surfaces of each of the polyhedral pieces are placed on triangle surfaces of other ones of the polyhedral pieces and the first and second cubes are placed on the same plane, in each of the first cube and the second cube, a first polyhedral piece for forming an upper face of each of the respective first and second cubes is coupled to a second polyhedral piece for forming a first side face of each of the respective first and second cubes and a third polyhedral piece for forming a second side face adjacent to the first side face at respective sides of a bottom face of the first polyhedral piece, the second polyhedral piece, and the third polyhedral piece, the second polyhedral piece is coupled to a fourth polyhedral piece for forming a third side face opposed to the second side face of each of the respective first and second cubes at respective sides of the bottom face of the second polyhedral piece and a bottom face of the fourth polyhedral piece, the fourth polyhedral piece is coupled to a fifth polyhedral piece for forming a lower face opposed to the upper face of each of the respective first and second cubes at respective sides of the bottom face of the fourth polyhedral piece and a bottom face of the fifth polyhedral piece, and the fifth polyhedral piece is coupled to a sixth polyhedral piece for forming a fourth side face opposed to the first side face of each of the respective first and second cubes at respective sides of the bottom face of the fifth polyhedral piece and a bottom face of the sixth polyhedral piece, wherein the third polyhedral piece of the first cube is coupled to the sixth polyhedral piece of the second cube at respective sides of the bottom faces of the third polyhedral piece of the first cube and the sixth polyhedral piece of the second cube, and wherein the third polyhedral piece of the second cube is coupled to the sixth polyhedral piece of the first cube at respective sides of the bottom faces of the third polyhedral piece of the second cube and the sixth polyhedral piece of the first cube.

2. The polyhedral toy according to claim 1, wherein the polyhedral toy comprises at least one polyhedral toy to be played.

3. The polyhedral toy according to claim 1, wherein the polyhedral toy comprises at least two polyhedral toys to be played through fitting to each other by male/female fitting.

4. The polyhedral toy according to claim 1, wherein the polyhedral toy comprises at least two polyhedral toys to be played through transformation like building blocks.

5. The polyhedral toy according to claim 1, wherein the twelve polyhedral pieces are coupled through one coupling member.

6. The polyhedral toy according to claim 5, wherein the twelve polyhedral pieces are coupled through one coupling member so as to spaced apart from one another.

7. The polyhedral toy according to claim 6, wherein a width dimension of the coupling member is shorter than a dimension of each of the sides of the bottom face of each of the polyhedral pieces.

8. The polyhedral toy according to claim 2, wherein the polyhedral toy comprises at least two polyhedral toys to be played through fitting to each other by male/female fitting.

9. The polyhedral toy according to claim 1, wherein the third polyhedral piece of the first cube is attached to the sixth polyhedral piece of the second cube at respective sides of the bottom faces of the third polyhedral piece of the first cube and the sixth polyhedral piece of the second cube.

10. The polyhedral toy according to claim 9, wherein the twelve polyhedral pieces are coupled through one coupling member.

11. An apparatus, comprising:

a plurality of polyhedral pieces each piece having a quadrangular pyramid shape;

wherein, in a folded state a first cube of polyhedral pieces and a second cube of polyhedral pieces are formed so that triangle surfaces of each of the polyhedral pieces are placed on triangle surfaces of other ones of the polyhedral pieces;

wherein in the folded state, the first cube and the second cube are arranged on the same plane;

the first cube comprising:

a first polyhedral piece for forming an upper face of the first cube is coupled to a second polyhedral piece for forming a first side face of the first cube and a third polyhedral piece for forming a second side face adjacent to the first side face at respective sides of bottom faces of the first polyhedral piece, the second polyhedral piece, and the third polyhedral piece;

the second polyhedral piece is coupled to a fourth polyhedral piece for forming a third side face opposed to the second side face of the first cube at respective sides of the bottom face of the second polyhedral piece and a bottom face of the fourth polyhedral piece;

the fourth polyhedral piece is coupled to a fifth polyhedral piece for forming a lower face opposed to the upper face of the first cube at respective sides of the bottom face of the fourth polyhedral piece and a bottom face of the fifth polyhedral piece; and the fifth polyhedral piece is coupled to a sixth polyhedral piece for forming a fourth side face opposed to the first side face of the first cube at respective sides of the bottom face of the fifth polyhedral piece and a bottom face of the sixth polyhedral piece, the second cube comprising:

a first polyhedral piece for forming an upper face of the second cube is coupled to a second polyhedral piece for forming a first side face of the second cube and a third polyhedral piece for forming a second side face adjacent to the first side face at respective sides of bottom faces of the first polyhedral piece, the second polyhedral piece, and the third polyhedral piece;

the second polyhedral piece is coupled to a fourth polyhedral piece for forming a third side face opposed to the second side face of the second cube at respective sides of the bottom face of the second polyhedral piece and a bottom face of the fourth polyhedral piece;

the fourth polyhedral piece is coupled to a fifth polyhedral piece for forming a lower face opposed to the upper face of the second cube at respective sides of the bottom face of the fourth polyhedral piece and a bottom face of the fifth polyhedral piece; and the fifth polyhedral piece is coupled to a sixth polyhedral piece for forming a fourth side face opposed to the first side face of the second cube at respective sides of the bottom face of the fifth polyhedral piece and a bottom face of the sixth polyhedral piece, wherein the third polyhedral piece of the first cube is coupled to the sixth polyhedral piece of the second cube at respective sides of the bottom faces of the third polyhedral piece of the first cube and the sixth polyhedral piece of the second cube, and wherein the third polyhedral piece of the second cube is coupled to the sixth polyhedral piece of the first cube at respective sides of the bottom faces of the third polyhedral piece of the second cube and the sixth polyhedral piece of the first cube.

12. The apparatus according to claim 11, wherein the plurality of polyhedral pieces are coupled through one coupling member.

13. The apparatus according to claim 11, wherein the plurality of polyhedral pieces are coupled through a coupling member so as to be spaced apart from one another, and wherein a width dimension of the coupling member is shorter than a dimension of each of the sides of the bottom face of each of the polyhedral pieces.

14. An apparatus comprising:

a first set of connected quadrangular pyramid shaped pieces, the first set of pieces comprising:

a first polyhedral piece having a first square base and four triangular surfaces extending from an edge of the first square base, a second polyhedral piece having a second square base and four triangular surfaces extending from an edge of the second square base, a third polyhedral piece having a third square base and four triangular surfaces extending from an edge of the third square base, a fourth polyhedral piece having a fourth square base and four triangular surfaces extending from an edge of the fourth square base, a fifth polyhedral piece having a fifth square base and four triangular surfaces extending from an edge of the fifth square base, and a sixth polyhedral piece having a sixth square base and four triangular surfaces extending from an edge of the sixth square base; and a second set of connected quadrangular pyramid shaped pieces, the second set of pieces comprising:

a first polyhedral piece having a first square base and four triangular surfaces extending from an edge of the first square base, a second polyhedral piece having a second square base and four triangular surfaces extending from an edge of the second square base, a third polyhedral piece having a third square base and four triangular surfaces extending from an edge of the third square base, a fourth polyhedral piece having a fourth square base and four triangular surfaces extending from an edge of the fourth square base, a fifth polyhedral piece having a fifth square base and four triangular surfaces extending from an edge of the fifth square base, and a sixth polyhedral piece having a sixth square base and four triangular surfaces extending from an edge of the sixth square base;

wherein the edge of third square base of the first set of pieces is directly attached to the edge of the sixth square base of the second set of pieces, wherein the edge of the first square base of the first set of pieces is directly attached to the edge of the second square base of the first set of pieces and directly attached to the edge of the third square base of the first set of pieces, wherein the edge of the second square base of the first set of pieces is directly attached to the edge of the fourth square base of the first set of pieces, wherein the edge of the fourth square base of the first set of pieces is directly attached to the edge of the fifth square base of the first set of pieces, and wherein the edge of the fifth square base of the first set of pieces is directly attached to the edge of the sixth square base of the first set of pieces.

15. The apparatus according to claim 14, wherein the edge of the first square base of the second set of pieces is directly attached to the edge of the second square base of the second set of pieces and directly attached to the edge of the third square base of the second set of pieces, wherein the edge of the second square base of the second set of pieces is directly attached to the edge of the fourth square base of the second set of pieces, wherein the edge of the fourth square base of the second set of pieces is directly attached to the edge of the fifth square base of the second set of pieces, and wherein the edge of the fifth square base of the second set of pieces is directly attached to the edge of the sixth square base of the second set of pieces.

16. The apparatus according to claim 14, wherein the apparatus has a folded state in which the first set of pieces are arranged to form a first cube and the second set of pieces are arranged to form a second cube.

17. The apparatus according to claim 16, wherein the first cube and the second cube are arranged on a plane.

18. The apparatus according to claim 16, wherein, in the folded state, the edge of the third square base of the second set of pieces abuts the edge of the sixth square base of the first set of pieces.

19. The apparatus according to claim 14, wherein in an unfolded state the first set of pieces and the second set of pieces are arranged on a plane.

20. The apparatus according to claim 15, wherein in an unfolded state the first set of pieces and the second set of pieces are arranged on a plane.

* * * * *